US006749323B1

(12) United States Patent
LaChance

(10) Patent No.: US 6,749,323 B1
(45) Date of Patent: Jun. 15, 2004

(54) APPARATUS FOR SIMULATING FALLING SNOWFLAKES

(76) Inventor: James L. LaChance, 21701 Sherwood, Belleville, MI (US) 48111

( * ) Notice: Subject to any disclaimer, the term of this patent is extended or adjusted under 35 U.S.C. 154(b) by 0 days.

(21) Appl. No.: 10/166,791

(22) Filed: Jun. 11, 2002

(51) Int. Cl.[7] ..... F21V 3/00

(52) U.S. Cl. ..... 362/282; 362/35; 362/322; 362/297; 362/806

(58) Field of Search ..... 362/35, 282, 322, 362/297, 806

(56) References Cited

U.S. PATENT DOCUMENTS 4,250,537 A * 2/1981 Roegner et al. ..... 362/86

6,145,228 A 11/2000 LaChance ..... 40/431

* cited by examiner

*Primary Examiner*—Sandra O'Shea
*Assistant Examiner*—Guiyoung Lee
(74) *Attorney, Agent, or Firm*—Charles W. Chandler

(57) ABSTRACT

A generally spherical body having a plurality of flat, small reflective surface elements is supported for rotation about a horizontal axis within a housing having an opening. A light source and a mirror are disposed in the housing to reflect light rays from the light source onto the mirror then to the spherical body to cause the light rays passing through the opening in the housing onto an exterior wall to simulate descending snowflakes. The mirror is adjustable in order to change the path of the simulated snowflakes on the wall.

4 Claims, 2 Drawing Sheets

APPARATUS FOR SIMULATING FALLING SNOWFLAKES

BACKGROUND AND SUMMARY OF THE INVENTION

This invention is related to apparatus for simulating falling snowflakes by disposing a spherical body covered with a plurality of planar reflective small surfaces, in the path of light rays reflected in a mirror. The angle of the mirror with respect to the spherical body can be adjusted in order to adjust the path of the simulated falling snowflakes.

A rotating sphere covered with small reflecting mirror surfaces in the path of light rays to project image patterns simulating falling snowflakes was disclosed in my prior U.S. Pat. No. 6,145,228 issued Nov. 14, 2000 for "Apparatus for Simulating Falling Snowflakes". The light source was mounted on a stake inserted in the ground an adjusted distance from the rotating body.

The present invention represents an improvement over my prior invention by housing both the light source and a mirror in a portable housing. The mirror is mounted in the housing and reflects the light rays from the light source toward the rotating sphere. The path of the descending simulated snowflakes is adjusted by adjusting the angle of the mirror surface with respect to the sphere. In the preferred embodiment, the mirror can be adjusted about a first axis that is parallel to the axis of rotation of the sphere, and a second axis that lies in a plane disposed at right angles to the axis of the sphere body. By making minor mirror adjustments, the user can change the path of motion of the simulated snowflakes. Further, the entire apparatus can be carried and stored within the housing.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENTS

Figure 1:
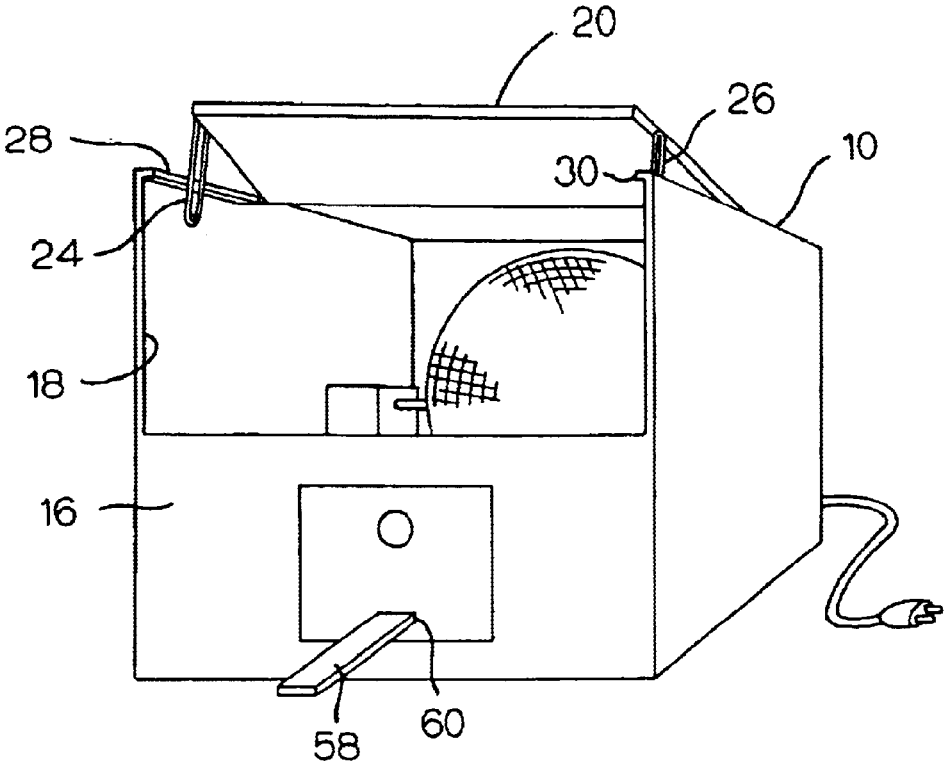
FIG. 1 is a perspective view of an apparatus illustrating the preferred embodiment of the invention.

FIG. 1 illustrates a hollow plastic housing 10 which may be about 18 inches high. The housing is formed of an opaque material and has a top wall 12 with an integral handle 14 for carrying the housing and its internal components.

The housing has a frontwall 16 with a light ray-emitting opening 18 which may be about 8 inches in height and 20 inches in width. Top wall 12 has a pivotally mounted panel 20 integrally hinged at 22 to define the upper edge of opening 18. The opening size is adjusted by adjusting the angle of panel 20 which is then supported in a raised position by a pair of supports 24 and 26 which engage lips 28 and 30 respectively on the housing side walls.

The housing has a bottom wall 32 which may be supported on a supporting surface such as the ground. The front housing wall also has an inward extending lip 33 which defines the bottom edge of the light ray-emitting opening. The lip extends about 3.5 inches into the interior of the housing.

A rotating body (sphere) 34 is mounted within the housing on axle means 36 for rotation about an axis 38 that is parallel to bottom wall 32.

The rotating body has a diameter of about 7 inches and is covered with an identical, contiguous, flat mirror surface elements 40. Each surface element, for illustrative purposes, is 1½inch square and has an outer reflective mirror surface 42.

Reflective surface 42 is disposed in a plane that forms a slight angle with respect to the reflective surfaces of adjacent elements 40. The reflective elements are supported in an edge-to-edge configuration over substantially the entire surface of the rotating body. The axis of rotation of the rotating body is about 10 inches above bottom wall 32. A light source 44 is mounted beneath the rotating body adjacent housing rear wall 46. Preferably the light source is a low voltage 30-watt light connected by an electrical conductor 46 to a suitable power source.

Light source 44 has a cylindrical housing and a funnel shaped face 48 terminating in a circular outlet opening 50 having a diameter of about ¾inch for reducing the width of light rays transmitted from the lamp.

A flat mirror 52 is mounted in the housing in the path of the light rays emitted from light source 44. The mirror reflects the light rays from the light source toward the reflective surfaces on the rotating body. The mirror, for illustrative purposes, is about 4 inches high and 6 inches wide. The mirror may be 4×4 inches square or it may take other sizes and configurations.

The mirror is mounted on a pivot 54 and rotatable about a vertical axis 56. A handle 58 attached to the mirror extends through opening 60 to pivot the mirror about an axis 56. The mirror is also mounted on a pivot 60 and pivotable about a horizontal axis 62 that is parallel to the axis of rotation 38 of the rotating body. Vertical axis 56 lies in a vertical plane that is generally at right angles to axis 38 of the rotating body. The user pivots handle 58 to move the mirror from an adjusted position "A" toward a second adjusted position illustrated in phantom at "B" to change the direction a reflected light ray, for example, shown at 64 received from the light source, toward the reflective surfaces on the rotating body 34.

Figure 4:
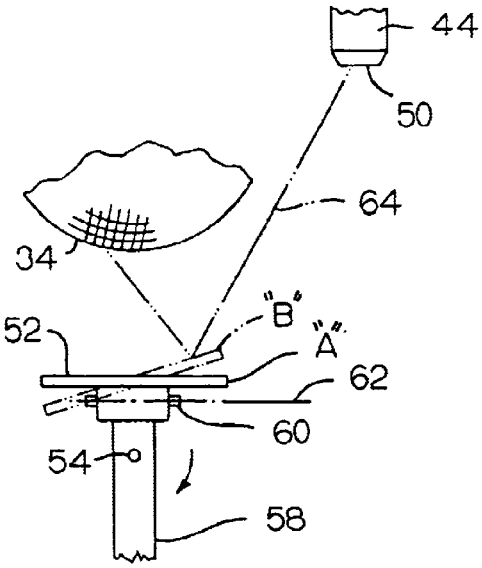
FIG. 4 is a schematic view illustrating how the mirror can be adjusted to change the path of the reflected rays onto the sphere.
Figure 5:
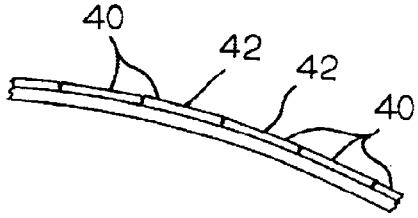
FIG. 5 is an enlarged sectional view showing a group of individual flat reflective surfaces on the sphere.

A threaded handle member 65 is pivotally connected at 65*a* to the rear of the mirror, and extends through a threaded opening in the front wall of the housing. A knob 66 is mounted on handle 65 such that by turning the knob, the angle of the mirror can be moved about axis 62 as shown in FIG. 4. A spring biased member 68 is mounted between the front wall of the housing and the mirror to stabilize the position of the mirror. Handle 65 is movable in the direction illustrated by arrows 70.

Figure 2:
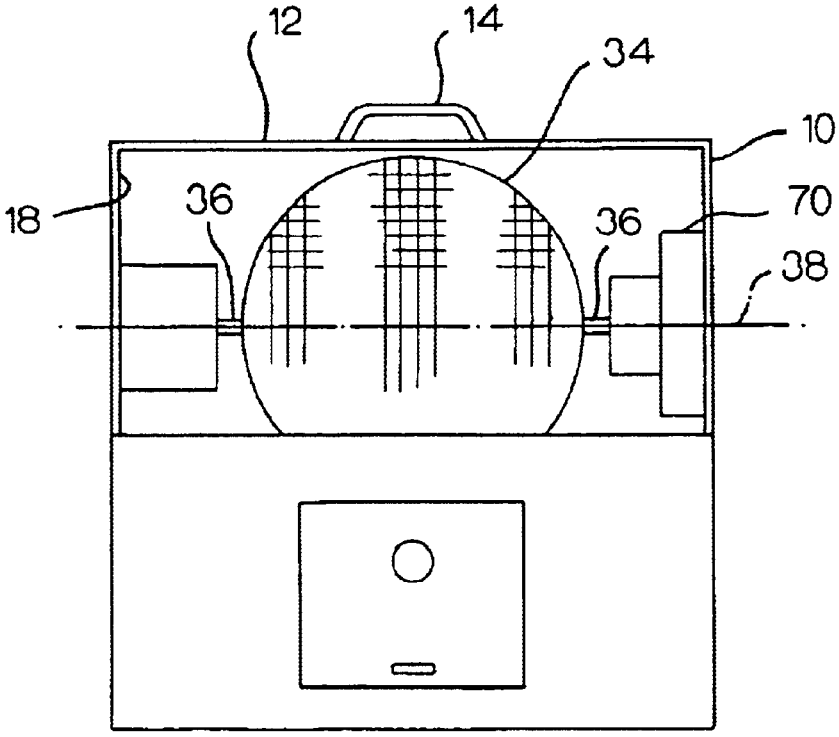
FIG. 2 is a view through the light emitting opening of the housing.
Figure 3:
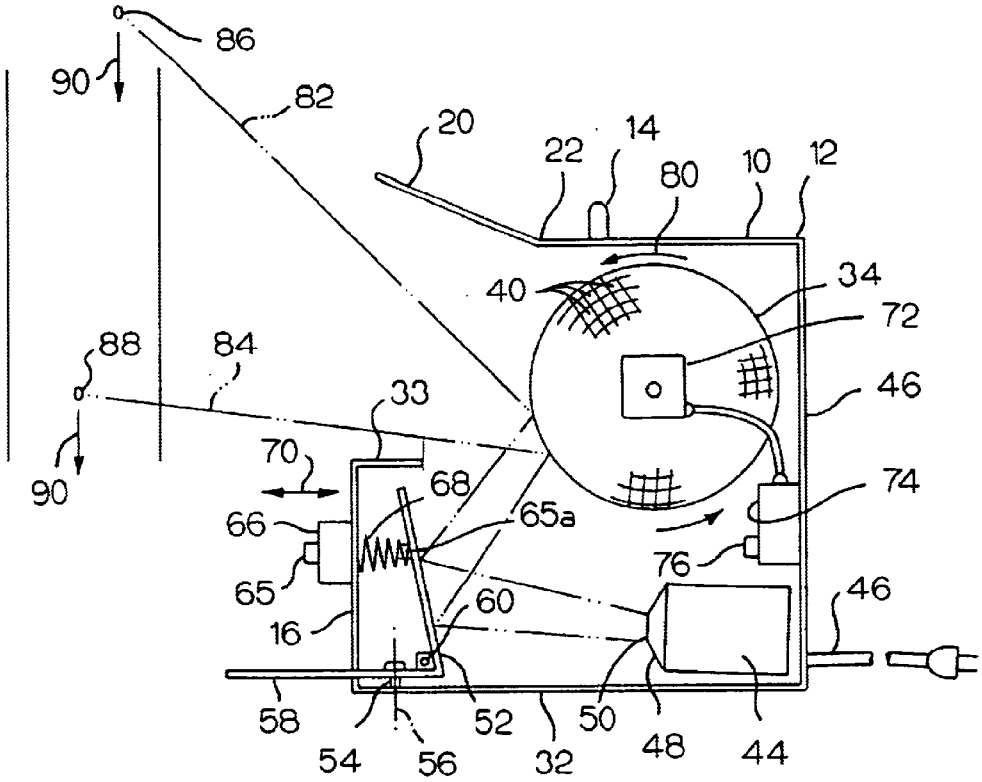
FIG. 3 is a sectional view through the preferred apparatus showing the sphere, the mirror and the light source.

Referring to FIG. 2, an electrically actuated motor 70 is connected to axle 36 of the rotating body to rotate it about axis 38. An electrical speed adjusting device 74 is mounted on the back wall of the housing and electrically connected to the motor so that the rotational speed of the motor can be either increased or reduced by rotating an adjusting knob 76.

The user locates the housing a selected distance from a wall 78. Panel 20 is adjusted in order to define the size of the light passing opening 18. The user then initiates the rotation of the rotating body in the direction of arrow 80. He energizes light source 44 to emit light rays toward the mirror which in turn reflects the light rays off the individual light reflective surfaces on the rotating body. The light rays are fragmented into individual light rays, for example, shown at 82 and 84. Each fragmented light ray forms a simulated image of a snowflake, for example, at 86 and 88 on wall 78. As the rotating body rotates, simulated snowflakes will descend on the wall in the direction of arrows 90.

The spacing of the simulated snowflakes can be adjusted by adjusting the mirror about horizontal axis 62 and vertical axis 56. Each light reflective surface on the rotating body will then project a simulated snowflake onto wall 78. The wall 78 may be either the exterior of a house or other building wall, or the interior of a room such as a gymnasium or the like.

Having described my invention, I claim:

1. A portable light-reflective apparatus for simulating falling snowflakes on a remote wall, comprising:

a housing having a light ray passing opening, an axle supported in the housing;

a rotating body secured to the axle for rotating about a horizontal axis;

said rotating body having an outer surface;

a plurality of light-reflecting surfaces carried on the outer surface of the rotating body in a generally globular arrangement, the light-reflecting surfaces on the rotating body comprising a plurality of adjacent, similarly-shaped, light-reflecting elements, each of said elements having a flat reflective surface disposed in a plane, the plane of each of said elements being at an angle from the planes of the adjacent light-reflecting elements;

a light source for transmitting light rays;

a mirror disposed in the path of the light rays emitted from the light source; and the mirror having a reflective surface facing the light reflecting surfaces carried on the rotating body, to reflect the light rays from the light source toward the light reflective surfaces at such an angle that the light rays are reflected out the light ray passing opening from individual light reflective surfaces to form a plurality of slowly descending spaced light images on a surface remote from the housing.

2. A portable light-reflective apparatus for simulating falling snowflakes on a remote wall, comprising:

a housing having a light ray passing opening, an axle supported in the housing;

a rotating body secured to the axle for rotating about a horizontal axis;

said rotating body having an outer surface;

a plurality of light-reflecting surfaces carried on the outer surface of the rotating body in a generally globular arrangement;

a light source for transmitting light rays;

a mirror disposed in the path of the light rays emitted from the light source;

the mirror having a reflective surface facing the light reflecting surfaces carried on the rotating body, to reflect the light rays from the light source toward the light reflective surfaces at such an angle that the light rays are reflected out the light ray passing opening from individual light reflective surfaces to form a plurality of slowly descending spaced light images on a surface remote from the housing; and the rotating body can be slowly rotated so that the reflected light images slowly descend on the remote surface to simulate falling snow.

3. A portable light-reflective apparatus for simulating falling snowflakes on a remote wall, comprising:

a housing having a light ray passing opening, an axle supported in the housing;

a rotating body secured to the axle for rotating about a horizontal axis;

said rotating body having an outer surface;

a plurality of light-reflecting surfaces carried on the outer surface of the rotating body in a generally globular arrangement;

a light source for transmitting light rays;

a mirror disposed in the path of the light rays emitted from the light source;

the mirror having a reflective surface facing the light reflecting surfaces carried on the rotating body, to reflect the light rays from the light source toward the light reflective surfaces at such an angle that the light rays are reflected out the light ray passing opening from individual light reflective surfaces to form a plurality of slowly descending spaced light images on a surface remote from the housing;

both the mirror and the light source being enclosed in the housing; and including structure mounted on the housing for supporting the mirror for motion between adjusted positions about an axis parallel to the axis of rotation of the rotating body, to adjust the path of the descending light images on said remote surface.

4. A portable light-reflective apparatus for simulating falling snowflakes on a remote wall, comprising:

a housing having a light ray passing opening, an axle supported in the housing;

a rotating body secured to the axle for rotating about a horizontal axis;

said rotating body having an outer surface;

a plurality of light-reflecting surfaces carried on the outer surface of the rotating body in a generally globular arrangement;

a light source for transmitting light rays;

a mirror disposed in the path of the light rays emitted from the light source; and the mirror having a reflective surface facing the light reflecting surfaces carried on the rotating body, to reflect the light rays from the light source toward the light reflective surfaces at such an angle that the light rays are reflected out the light ray passing opening from individual light reflective surfaces to form a plurality of slowly descending spaced light images on a surface remote from the housing;

both the mirror and the light source being enclosed in the housing; and structure mounted on the housing for supporting the mirror for motion about an axis generally at right angles to the axis of rotation of the rotating body, to adjust the path of the descending light images on said remote surface.

* * * * *